US006457946B2

(12) United States Patent
Gretzschel et al.

(10) Patent No.: US 6,457,946 B2
(45) Date of Patent: Oct. 1, 2002

(54) REGULATABLE PUMP

(75) Inventors: Marko Gretzschel, Berlin (DE); Nico Jäkel, Berlin (DE); Tilo Koch, Berlin (DE); Jörg Pätzold, Schönfeld-Weissing (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/746,071

(22) Filed: Dec. 26, 2000

(30) Foreign Application Priority Data

Dec. 23, 1999 (DE) ..... 199 62 554

(51) Int. Cl.[7] ..... F04B 49/00

(52) U.S. Cl. ..... 417/220; 417/274; 418/26; 418/30

(58) Field of Search ..... 417/220, 213, 417/274; 418/26, 27, 30

(56) References Cited

U.S. PATENT DOCUMENTS 3,918,855 A * 11/1975 Bornholdt ..... 418/24
4,558,998 A * 12/1985 Kiyoshige et al. ..... 418/26
5,090,881 A * 2/1992 Suzuki et al. ..... 418/26
5,366,354 A * 11/1994 Yuge ..... 418/26

FOREIGN PATENT DOCUMENTS

| | | | |
|---|---|---|---|
| DE | GB 2 146 701 A | * | 4/1985 |
| EP | 2015744 | | 10/1971 |
| EP | 0049838 | | 4/1982 |
| EP | 3333647 A1 | | 5/1984 |
| EP | 4302610 A1 | | 8/1994 |
| GB | 21 46 701 A | * | 4/1985 |
| JP | 0 049 838 A1 | * | 4/1982 |
| JP | 358096191 A | * | 6/1983 |

* cited by examiner

*Primary Examiner*—Charles G. Freay
*Assistant Examiner*—Han Lieh Liu
(74) *Attorney, Agent, or Firm*—Crowell & Moring LLP

(57) ABSTRACT

A regulatable pump, in particular a vane pump, is provided with a rotor, with a rotor body and with at least one guide ring and with a cam ring. The eccentricity of the cam ring can be adjusted by means of a regulating piston, a journal of the cam ring lying between a spring-pretensioning means and the regulating piston. At maximum eccentricity, the cam ring bears on the outside by means of a bearing part of its circumferential wall against a bearing surface on the inside of the housing.

3 Claims, 1 Drawing Sheet

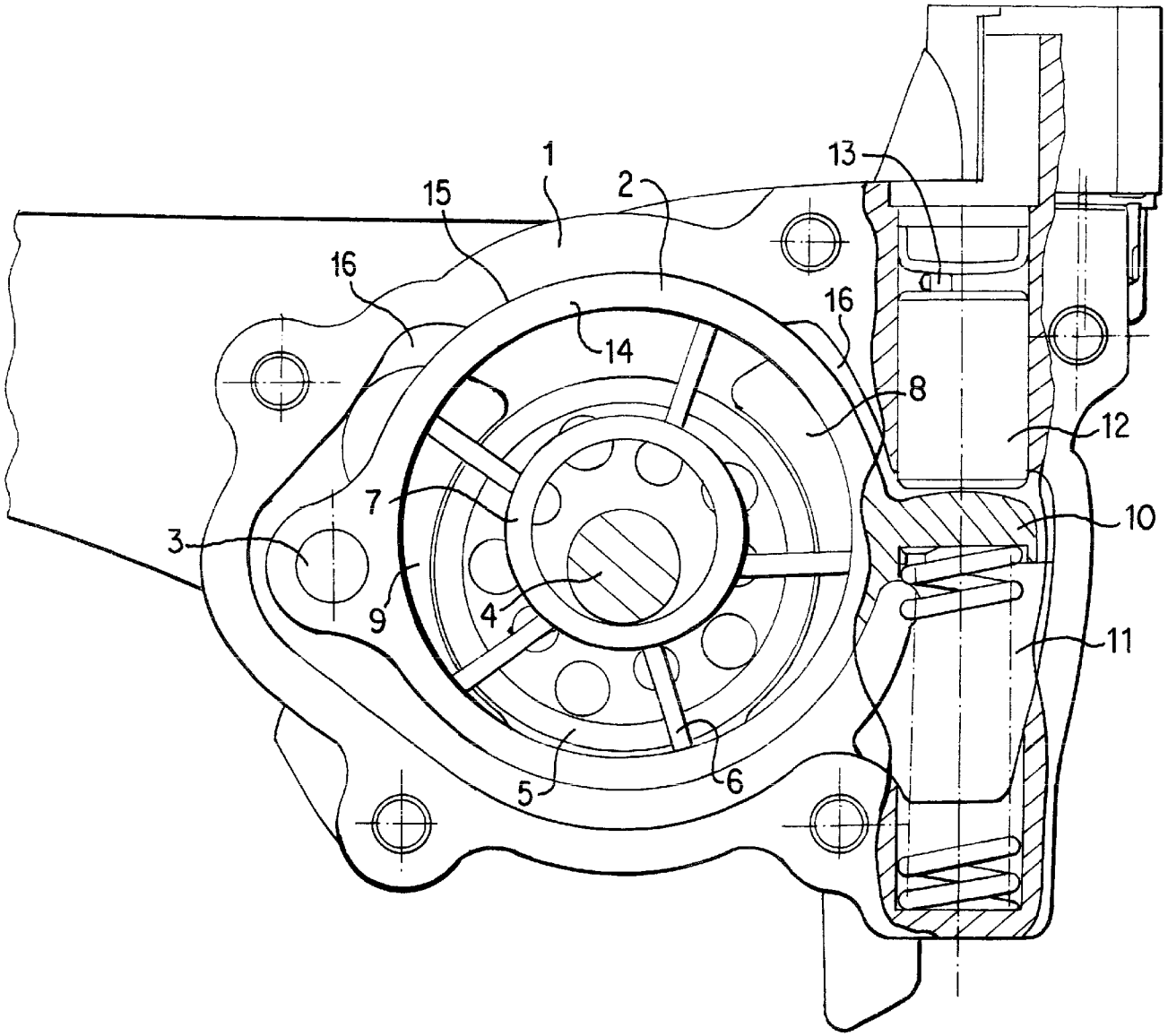
1
2
3
4
5
6
7
8
9
10
11
12
13
14
15
16
16

REGULATABLE PUMP

The invention relates to a regulatable pump, in particular a vane pump, in accordance with the type defined in greater detail in the preamble of claim 1.

DE 33 33 647 C2 discloses a regulatable pump having radially displaceable vanes and a cam ring whose eccentricity can be adjusted by means of a regulating piston, a journal of the cam ring lying between a counter support having a compression spring and a regulating piston. The position of the cam ring determines the size of the eccentricity and therefore the delivery rate of the pump. The regulating piston is clamped between the housing and the journal or stud of the cam ring for the purpose of adjusting the eccentricity. A linear load accordingly occurs between the journal and the regulating piston. It has turned out in practice that after sustained running, severe traces of wear are apparent both on the regulating piston and on the journal of the cam ring. Because of the highly dynamic loads acting on the cam ring, the latter is caused to vibrate, the vibration being transmitted to the journal of the cam ring or to the regulating piston exclusively via the linear contact. These vibrations are one of the main causes of the considerable wear phenomena. The wear can cause changes, namely an increase in the eccentricity, which in the most disadvantageous case leads to the rotating parts jamming and therefore to a failure of the pump.

As regards further prior art, reference is made to DE 43 02 610 A1 which reveals a lubricating pump, in which the intention is for the delivery rate to be additionally and independently restricted via detection of temperature and/or speed. For this purpose, a wedge-shaped actuating element is provided which bears in linear contact against the circumference of the cam ring and which, together with the regulating piston, influences or regulates the eccentricity of the cam ring.

The present invention is based on the object of providing a regulatable vane pump of the type mentioned at the beginning in which wear phenomena are, as far as possible, avoided.

According to the invention, this object is achieved by the features mentioned in claim 1.

By virtue of the fact that the journal of the cam ring is no longer wedged in linear contact between the regulating piston and the counter support, but that, in accordance with the invention, there is now surface bearing with simultaneous relief of load on the regulating piston, the disadvantageous traces of wear, as are the case in the prior art, no longer occur. The position of the cam ring is now determined by the surface bearing in the housing, as a result of which the piston can be mounted freely. This avoids the hitherto known distortions of the cam ring and of its journal and of the piston.

Advantageous refinements and developments emerge from the subclaims and from the exemplary embodiment described schematically below with reference to the drawing.

The single FIGURE shows a cross section through a regulatable vane pump. Instead of achieving the invention using a vane pump, other pumps, for example internal gear pumps, may also be provided in an appropriate embodiment.

In principle, the design of the vane pump illustrated and described below and its manner of operation is known and so only the parts which are essential for the invention are described in more detail.

In a housing 1 of the vane pump a cam ring 2 is mounted pivotably on one side in the housing 1 via a bearing journal 3.

Situated in the interior of the cam ring 2 is a rotor or drive shaft 4, a rotor body 5, which is also called a pump impeller, in which a plurality of radially displaceable vanes 6 are distributed over the circumference, and a guide ring 7 for the radial internal support of the vanes 6 against the cam ring 2.

Furthermore, the vane pump has in a known manner a kidney-shaped forcing means 8, which is connected to an outlet (not illustrated), and a kidney-shaped sucking means 9, which is connected to an inlet (likewise not illustrated).

The cam ring 2 is provided on its outer circumference with an actuating-ring stud or journal 10. The journal 10 lies between a spring-pretensioning means 11 having a spring which is supported at its one end against the housing 1 while it is pressed with its other end against the journal 10. A regulating piston 12 bears, by means of its front end wall, on the side which faces away from this side. On its rear side, the regulating piston 12 has a pressure chamber 13 which is pressure-actuated in a known manner in order to displace the regulating piston.

The vane pump illustrated in the FIGURE is in the position of maximum eccentricity. This means that the regulating piston 12 is in its retracted or withdrawn position, while the spring 11 has been extended to its maximum position. In this position, the vane pump has its maximum delivery rate. However, in contrast to the known solutions, the regulating piston 12 in this case is mounted freely and the journal 10 is no longer wedged 10 firmly between the spring 11 and the regulating piston 12. On the contrary, the cam ring 2 bears by means of a bearing part 14 of its outer circumferential wall against a bearing surface 15 of the inside of the housing 1. In the maximum position of eccentricity of the cam ring 2, the regulating piston 12 can be completely relieved of load and, if appropriate, pressure is no longer applied to it. The bearing part 14 of the circumferential wall, by means of which the cam ring 2 bears against the housing 1, extends over an angular range of approximately 70°. Of course, however, other angular ranges are also possible here in accordance with the requirements, the pressure ratios and the size of the vane pump.

In order to provide a defined bearing surface 15 on the inside of the housing 1, on both sides (with reference to the circumference) of the bearing surface 15 the housing 1 is provided with a cutout or a recess 16 resulting in a slight increase in the diameter of the housing 1 and therefore in a defined bearing surface. At the same time, the outlay on machining for the inside of the housing 1 is thereby reduced.

In contrast to the prior art, with no contact being provided between the cam ring 2 and the housing 1 even at maximum eccentricity, there is therefore provided between the bearing part 14 and the bearing surface 15 a defined bearing arrangement for the cam ring 2 in the manner of a sliding bearing which is insensitive to the vibrations.

The housing 1 can consist of an aluminium material and the cam ring 2 of a sintered material producing a good pairing of sliding bearings in the region of the bearing part 14 of the cam ring 2 and the bearing surface 15 of the housing 1. Since this arrangement does not involve any high-quality materials, a solution which is cost-effective in terms of structure is provided in this manner.

What is claimed is:

1. Regulatable pump, in particular vane pump, having a housing, a rotor, a rotor body, at least one guide ring, a cam ring whose eccentricity can be adjusted by a regulating piston, with a journal of the cam ring lying between a spring-pretensioning device and the regulating piston, wherein at maximum eccentricity, a circumferential wall of the cam ring has a bearing part that bears against a bearing surface inside housing and the bearing part extends over a range from 10° to 80°.

2. Pump according to claim 1, wherein, on both sides of the bearing surface the housing is provided with a cutout or a recess.

3. Pump according to claim 1, wherein the bearing part extends over a range from 10° to 70°.

* * * * *